US009440462B2

(12) United States Patent
Nakamura

(10) Patent No.: US 9,440,462 B2
(45) Date of Patent: Sep. 13, 2016

(54) IMAGE FORMING DEVICE

(71) Applicant: FUJIFILM CORPORATION, Minato-ku, Tokyo (JP)

(72) Inventor: Takayuki Nakamura, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/834,437

(22) Filed: Aug. 25, 2015

(65) Prior Publication Data

US 2015/0360483 A1 Dec. 17, 2015

Related U.S. Application Data

(63) Continuation of application No. PCT/JP2014/052338, filed on Jan. 31, 2014.

(30) Foreign Application Priority Data

Mar. 6, 2013 (JP) ..... 2013-044448

(51) Int. Cl.

| | |
|---|---|
| ***B41J 11/00*** | (2006.01) |
| ***B65H 29/04*** | (2006.01) |
| ***B65H 29/52*** | (2006.01) |

(52) U.S. Cl.

CPC ..... *B41J 11/0085* (2013.01); *B65H 29/041* (2013.01); *B65H 29/52* (2013.01); *B65H 2301/517* (2013.01); *B65H 2301/5305* (2013.01); *B65H 2406/122* (2013.01); *B65H 2406/351* (2013.01); *B65H 2801/31* (2013.01)

(58) Field of Classification Search

CPC .. B41J 11/0085; B65H 29/52; B65H 29/041; B65H 2301/517

See application file for complete search history.

(56) References Cited

U.S. PATENT DOCUMENTS

| | | | | |
|---|---|---|---|---|
| 2009/0295894 | A1 | 12/2009 | Hori | |
| 2010/0231676 | A1* | 9/2010 | Miyagi | B41J 2/16585 347/104 |
| 2013/0044169 | A1 | 2/2013 | Chiwata | |
| 2013/0050377 | A1 | 2/2013 | Inoue | |

FOREIGN PATENT DOCUMENTS

| | | | |
|---|---|---|---|
| JP | 2005-324443 | A | 11/2005 |
| JP | 2009-208965 | A | 9/2009 |
| JP | 2009-285877 | A | 12/2009 |
| JP | 2013-039820 | A | 2/2013 |
| JP | 2013-043752 | A | 3/2013 |

OTHER PUBLICATIONS

International Search Report issued in International Application No. PCT/JP2014/052338 on Mar. 4, 2014.

Written Opinion of the ISA issued in International Application No. PCT/JP2014/052338 on Mar. 4, 2014.

English language translation of the following: Office action dated Nov. 4, 2015 from the JPO in a Japanese patent application corresponding to the instant patent application. This office action translation is submitted now in order to supplement the understanding of the cited references which are being disclosed in the instant Information Disclosure Statement.

* cited by examiner

*Primary Examiner* — Sarah Al Hashimi

(74) *Attorney, Agent, or Firm* — Solaris Intellectual Property Group, PLLC

(57) ABSTRACT

The present invention provides an image forming device having: a conveying mechanism that pulls and conveys a recording medium onto which liquid drops have been applied; and a suction plate that is provided with a plurality of suction holes that suck the recording medium conveyed by the conveying mechanism, and at which, when the suction holes are projected in a conveying direction of the recording medium, the suction holes are disposed such that any one of the suction holes exists in a direction orthogonal to the conveying direction of the recording medium, and the suction holes are disposed so as to overlap one another.

6 Claims, 7 Drawing Sheets

IMAGE FORMING DEVICE

CROSS-REFERENCE TO RELATED APPLICATION

This application is a continuation application of international Application No. PCT/JP2014/052338, filed Jan. 31, 2014, which is based upon and claims the benefit of priority of Japanese Patent Application No. 2013-044448, filed on Mar. 6, 2013. The entire contents of these applications are incorporated herein by reference.

FIELD

The present invention relates to an image forming device.

BACKGROUND

The structure of an inkjet recording device, that conveys a sheet by pulling the sheet while causing the sheet to contact a suction plate, is disclosed in Patent Document 1 (Japanese Patent Application Laid-Open (JP-A) No. 2009-285877). Plural suction holes for sucking the sheet are formed in the suction plate. The diameter of or the number of the suction holes is increased or the like such that, the further toward the conveying direction upstream side of the suction plate, the stronger the suction amount, and further, the stronger the suction amount of the transverse direction central portion of the suction plate. Concretely, the further toward the transverse direction central portion of the suction plate, the greater the opening diameter of the suction holes, and further, the further toward the conveying direction upstream side of the suction plate, the greater the opening diameter of the suction holes.

In an inkjet printing device, suction holes must be provided at an interval such that sufficient suction force is obtained in the transverse direction and in the sheet conveying direction of the suction plate at the time when a sheet is sucked to the suction plate.

Such a suction plate is used also within a drying section that dries ink that has been ejected-out onto a sheet. For example, when the suction plate disclosed in Patent Document 1 (JP-A No. 2009-285877) is provided in a drying section, there is the possibility that the dried state of the sheet will differ at regions of the sheet that pass by the suction holes and regions that do not pass by the suction holes, and that non-uniform drying will occur. Therefore, at the time when a sheet is conveyed while contacting the suction plate, due to dispersion arising in the cumulative passage times at the portions of the suction plate where the suction holes are formed and the portions where the suction holes are not formed, there is the possibility that differences will arise in the temperature distribution at the time of drying the sheet, and that non-uniformity of the image due to non-uniform drying will arise.

In consideration of the above-described circumstances, a topic of the present invention is the providing of an image forming device that can reduce the occurrence of dispersion in cumulative passage times of a recording medium at portions on a suction plate where suction holes are formed and portions where suction holes are not formed.

SUMMARY

An image forming device of a first form of the present invention comprises: a conveying mechanism that pulls and conveys a recording medium onto which liquid drops have been applied; and a suction plate that is provided with a plurality of suction holes that suction the recording medium conveyed by the conveying mechanism, and at which sizes of the plurality of suction holes are uniform, and, when the suction holes are projected in a conveying direction of the recording medium, the suction holes are disposed such that any one of the suction holes is disposed in a direction that is orthogonal to the conveying direction of the recording medium, and the suction holes are disposed so as to overlap one another.

In accordance with the image forming device of the first form of the present invention, the recording medium to which liquid drops have been applied is conveyed while being pulled by the conveying mechanism on the suction plate. Plural suction holes that suck the recording medium are formed in the suction plate, and the recording medium is sucked to the suction plate and conveyed. At the suction plate, when the plural suction holes are projected in the conveying direction of the recording medium, the suction holes are disposed such that any one of the suction holes disposed in the direction orthogonal to the conveying direction of the recording medium, and the suction holes are disposed so as to overlap one another. Due to such an arrangement of the plural suction holes, the recording medium that is conveyed is made to be in a state in which there is no region thereof that is always contacting the suction plate. Due thereto, when the recording medium is conveyed while being sucked to the suction plate, dispersion arising in the cumulative passage times of the recording medium at the portions on the suction plate where the suction holes are formed and the portions where the suction holes are not formed is reduced.

In an image forming device of a second form of the present invention, in the image forming device of the first form, the suction holes, that structure a row of holes in the conveying direction of the recording medium, are configured so as to be offset, each by a uniform amount, in the direction that is orthogonal to the conveying direction of the recording medium, and periodically return to an original arrangement of the row of holes.

In accordance with the image forming device of the second form of the present invention, the suction holes, that structure a row of holes in the conveying direction of the recording medium, are structured so as to be offset, each by a uniform amount, in the direction orthogonal to the conveying direction of the recording medium, and periodically return to the original arrangement of the row of holes. Due thereto, when the recording medium is conveyed while being sucked to the suction plate, dispersion arising in the cumulative passage times of the recording medium at the portions on the suction plate where the suction holes are formed and the portions where the suction holes are not formed is reduced more reliably.

In an image forming device of a third form of the present invention, in the image forming device of the first form, the suction holes, that structure a row of holes in the conveying direction of the recording medium, are offset in the direction that is orthogonal to the conveying direction of the recording medium, and arrays of the suction holes, having hole positions offset and that are in the direction that is orthogonal to the conveying direction of the recording medium, are disposed in a random order in the conveying direction of the recording medium.

In accordance with the image forming device of the third form of the present invention, the suction holes, that structure a row of holes in the conveying direction of the recording medium, are offset in the direction orthogonal to the conveying direction of the recording medium, and arrays of the suction holes, whose hole positions are offset and that are in the direction orthogonal to the conveying direction of the recording medium, are disposed in a random order in the conveying direction of the recording medium. Due thereto, when the recording medium is conveyed while being sucked to the suction plate, dispersion arising in the cumulative passage times of the recording medium at the portions on the suction plate where the suction holes are formed and the portions where the suction holes are not formed is reduced more reliably.

In an image forming device of a fourth form of the present invention, in the image forming device of the first form, a drying device, that dries the liquid drops that have been applied to the recording medium, is provided at a position facing the suction plate.

In accordance with the image forming device of the fourth form of the present invention, the drying device is provided at a position facing the suction plate, and the liquid drops that have been applied to the recording medium are dried by the drying device. At this time, the recording medium is conveyed while being sucked to the suction plate, and dispersion arising in the cumulative passage times of the recording medium at the portions on the suction plate where the suction holes are formed and the portions where the suction holes are not formed is reduced. Therefore, the arising of differences in the temperature distribution at the time of drying the recording medium is suppressed, and the occurrence of non-uniformity of the image can be suppressed.

In an image forming device of a fifth form of the present invention, in the image forming device of the fourth form, a cooling liquid circulating device, that cools a surface of contact with the recording medium by circulating cooling liquid at an interior of the suction plate, is provided at the suction plate.

In accordance with the image forming device of the fifth form of the present invention, the surface of contact with the recording medium is cooled due to cooling liquid being circulated at the interior of the suction plate by the cooling liquid circulating device. Due thereto, a rise in the temperature of the suction plate due to the drying device is suppressed. At this time, dispersion arising in the cumulative passage times of the recording medium at the portions on the suction plate where the suction holes are formed and the portions where the suction holes are not formed is reduced, and the arising of differences in the temperature distribution at the time of drying the recording medium is suppressed.

In an image forming device of a sixth form of the present invention, in the image forming device of the first form, the conveying mechanism has a chain gripper that grasps a leading end portion of the recording medium and conveys the recording medium along the suction plate.

In accordance with the image forming device of the sixth form of the present invention, the recording medium is sucked and conveyed while being made to contact the suction plate, due to movement of the chain gripper and in a state in which the leading end portion of the recording medium is grasped by the chain gripper. At this time, dispersion arising in the cumulative passage times of the recording medium at the portions on the suction plate where the suction holes are formed and the portions where the suction holes are not formed is reduced.

In an image forming device of a seventh form of the present invention, in the image forming device of the fourth form, a liquid drop curing device, that cures the liquid drops that have been applied to the recording medium, is provided further toward a conveying direction downstream side of the recording medium than the drying device.

In accordance with the image forming device of the seventh form of the present invention, the liquid drop curing device, that cures the liquid drops that have been applied to the recording medium, is provided further toward a conveying direction downstream side of the recording medium than the drying device. Due thereto, when the recording medium is conveyed while contacting the suction plate, the liquid drops that have been applied to the recording medium are cured by the liquid drop curing device. At this time, dispersion arising in the cumulative passage times of the recording medium at the portions on the suction plate where the suction holes are formed and the portions where the suction holes are not formed is reduced. Therefore, the arising of differences in the temperature distribution of the recording medium is suppressed, and the occurrence of non-uniformity of the image can be suppressed.

In accordance with the image forming device relating to the present invention, the occurrence of dispersion in cumulative passage times of a recording medium at portions on a suction plate where suction holes are formed and portions where suction holes are not formed can be reduced.

DESCRIPTION OF EMBODIMENTS

Examples of embodiments relating to the present invention are described hereinafter with reference to the drawings.

First Embodiment

Device Structure

Figure 1:
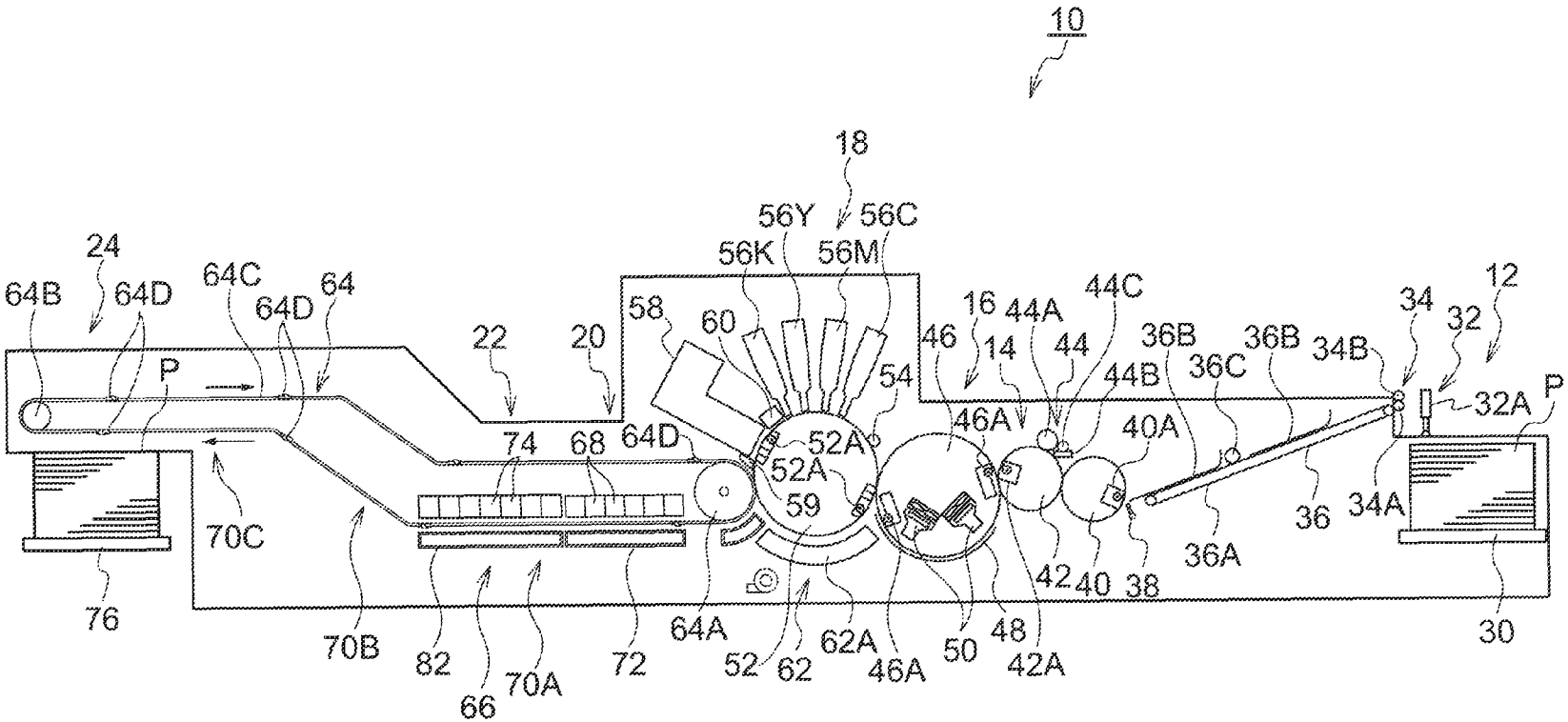
FIG. 1 is a front view showing an image forming device relating to a first embodiment of the present invention.

FIG. 1 is an overall structural drawing showing a first embodiment of an inkjet recording device that serves as an image forming device relating to the present invention.

An inkjet recording device 10 is an inkjet recording device that records images by an inkjet method and by using aqueous UV inks (UV (ultraviolet ray) curable inks that use an aqueous medium) on sheet-like sheets (recording media) P. This inkjet recording device 10 mainly has a sheet feeding section 12 that feeds the sheets P, a processing liquid applying section 14 that applies a predetermined processing liquid to the obverse (image recording surface) of the sheet P that has been fed from the sheet feeding section 12, a processing liquid drying processing section 16 that carries out drying processing of the sheet P onto which the processing liquid has been applied at the processing liquid applying section 14, an image recording section 18 that records an image by an inkjet method and by using aqueous UV inks onto the obverse of the sheet P that has been subjected to drying processing at the processing liquid drying processing section 16, an ink drying processing section 20 that carries out drying processing of the sheet P on which an image has been recorded at the image recording section 18, a UV irradiating processing section 22 that carries out UV irradiating processing (fixing processing) on the sheet P that has been subjected to drying processing at the ink drying processing section 20 and fixes the image, and a sheet discharging section 24 that discharges the sheet P that has been subjected to UV irradiating processing at the UV irradiating processing section 22.

<Sheet Feeding Section>

The sheet feeding section 12 feeds the sheets P, that are stacked on a sheet feeding stand 30, one-by-one to the processing liquid applying section 14. The sheet feeding section 12 that serves as an example of a sheet feeding device is mainly structured by the sheet feeding stand 30, a sucker device 32, a sheet feeding roller pair 34, a feeder board 36, a front abutter 38, and a sheet feeding drum 40.

The sheets P are placed on the sheet feeding stand 30 in the state of a sheaf in which numerous sheets are stacked. The sheet feeding stand 30 is provided so as to be able to be raised and lowered by an unillustrated sheet feeding stand raising/lowering device. The driving of the sheet feeding stand raising/lowering device is controlled interlockingly with the increase/decrease in the sheets P that are stacked on the sheet feeding stand 30, and the sheet feeding stand raising/lowering device raises and lowers the sheet feeding stand 30 such that the sheet P, that is positioned topmost in the sheaf, is always positioned at a constant height.

The sheet P that serves as a recording medium is not particularly limited, and general printing sheets (sheets whose main component is cellulose such as so-called high-grade paper, coated paper, art paper or the like) that are used in general offset printing and the like can be used. In the present example, coating-processed paper is used. Coating-processed paper is paper in which a coating layer is provided by coating a coating agent onto the surface of high-grade paper or acid-free paper or the like that generally has not been surface treated. Concretely, art paper, coated paper, light-weight coated paper, finely coating-processed paper, and the like are suitably used.

The sucker device 32 takes-up the sheets P, that are stacked on the sheet feeding stand 30, one-by-one in order from the top, and feeds the sheets P to the sheet feeding roller pair 34. The sucker device 32 has a suction foot 32A that is provided so as to freely rise and fall and so as to swing freely. The top surface of the sheet P is sucked and held by this suction foot 32A, and the sucker device 32 moves the sheet P from the sheet feeding stand 30 to the sheet feeding roller pair 34. At this time, the suction foot 32A sucks and holds the top surface of the leading end side of the sheet P that is positioned at the topmost position of the sheaf, and pulls the sheet P up, and inserts the leading end of the pulled-up sheet P between a pair of rollers 34A, 34B that structure the sheet feeding roller pair 34.

The sheet feeding roller pair 34 is structured by the pair of upper and lower rollers 34A, 34B that are pushed to abut one another. One of the pair of upper and lower rollers 34A, 34B is made to be a driving roller (the roller 34A), and the other is made to be a driven roller (the roller 34B). The driving roller (the roller 34A) is driven by an unillustrated motor and rotates. The motor is driven interlockingly with the feeding of the sheets P. When the sheet P is fed from the sucker device 32, the motor rotates the driving roller (the roller 34A) in accordance with the timing thereof. The sheet P, that has been inserted between the pair of upper and lower rollers 34A, 34B, is nipped by these rollers 34A, 34B, and is sent-out in the rotating direction of the rollers 34A, 34B (the direction in which the feeder board 36 is set).

The feeder board 36 is formed so as to correspond to the sheet width, and receives the sheet P that is sent-out from the sheet feeding roller pair 34, and guides the sheet P to as far as the front abutter 38. This feeder board 36 is set so as to be inclined downward, and causes the sheet P that has been placed on the conveying surface thereof to slide along the conveying surface, and guides the sheet P to as far as the front abutter 38.

Plural tape feeders 36A for conveying the sheet P are set at the feeder board 36 at intervals in the transverse direction. The tape feeders 36A are formed in endless forms, and are driven by an unillustrated motor and rotate. Movement is imparted by these tape feeders 36A to the sheet P that has been placed on the conveying surface of the feeder board 36, and the sheet P is conveyed on the feeder board 36.

Further, retainers 36B and a roller 36C are set above the feeder board 36. The plural (two in the present example) retainers 36B are disposed so as to be lined-up lengthwise front and rear along the conveying surface of the sheet P. The retainers 36B are structured by plate springs that have widths corresponding to the sheet width, and are set so as to be pushed against and abut the conveying surface. The convexity and concavity of the sheet P, that is conveyed on the feeder board 36 by the tape feeders 36A, are corrected due to the sheet P passing by these retainers 36B. Note that the rear end portions of the retainers 36B are formed so as to be curled in order to easily introduce the sheet P in between the retainers 36B and the feeder board 36.

The roller 36C is disposed between the front and rear retainers 36B. This roller 36C is set so as to be pushed and abutted against the conveying surface of the sheet P. The sheet P, that is conveyed between the front and rear retainers 36B, is conveyed while the top surface thereof is held down by the roller 36C.

The front abutter 38 corrects the posture of the sheet P. This front abutter 38 is formed in a plate shape, and is disposed orthogonal to the conveying direction of the sheet P. Further, the front abutter 38 is driven by an unillustrated motor, and is provided so as to be swingable. The leading end of the sheet P, that was conveyed on the feeder board 36, is made to abut the front abutter 38, and the posture of the sheet P is corrected (so-called skew prevention). The front abutter 38 swings interlockingly with the feeding of the sheet to the sheet feeding drum 40, and transfers the sheet P whose posture has been corrected to the sheet feeding drum 40.

The sheet feeding drum 40 receives the sheet P that is fed from the feeder board 36 via the front abutter 38, and conveys the sheet P to the processing liquid applying section 14. The sheet feeding drum 40 is formed in a cylindrical shape, and is driven by an unillustrated motor and rotates. A gripper 40A is provided on the outer peripheral surface of the sheet feeding drum 40, and the leading end of the sheet P is grasped by this gripper 40A. Due to the sheet feeding drum 40 rotating while grasping the leading end of the sheet P by the gripper 40A, the sheet feeding drum 40 conveys the sheet P to the processing liquid applying section 14 while training the sheet P on the peripheral surface thereof.

The sheet feeding section 12 is structured as described above. The sheets P that are stacked on the sheet feed stand 30 are pulled-up one-by-one in order from the top by the sucker device 32, and are fed to the sheet feeding roller pair 34. The sheet P that has been fed to the sheet feeding roller pair 34 is sent-out forward by the pair of upper and lower rollers 34A, 34B that structure this sheet feeding roller pair 34, and is placed on the feeder board 36. The sheet P that has been placed on the feeder board 36 is conveyed by the tape feeders 36A that are provided at the conveying surface of the feeder board 36. Then, in this conveying process, the sheet P is pushed against the conveying surface of the feeder board 36 by the retainers 36B, and the convexity and concavity of the sheet P are corrected. Due to the leading end of the sheet P that has been conveyed by the feeder board 36 being made to abut the front abutter 38, tilting is corrected, and thereafter, the sheet P is transferred to the sheet feeding drum 40. Then, the sheet P is conveyed to the processing liquid applying section 14 by this sheet feeding drum 40.

<Processing Liquid Applying Section>

The processing liquid applying section 14 applies a predetermined processing liquid to the obverse (the image recording surface) of the sheet P. This processing liquid applying section 14 is structured mainly by a processing liquid applying drum 42 that conveys the sheet P, and a processing liquid applying unit 44 that applies the predetermined processing liquid to the printing surface of the sheet P conveyed by the processing liquid applying drum 42.

The processing liquid applying drum 42 receives the sheet P from the sheet feeding drum 40 of the sheet feeding section 12, and conveys the sheet P to the processing liquid drying processing section 16. The processing liquid applying drum 42 is formed in a cylindrical shape, and is driven by an unillustrated motor and rotates. A gripper 42A is provided on the outer peripheral surface of the processing liquid applying drum 42, and the leading end of the sheet P is grasped by this gripper 42A. Due to the processing liquid applying drum 42 rotating while grasping the leading end of the sheet P by this gripper 42A, the processing liquid applying drum 42 conveys the sheet P to the processing liquid drying processing section 16 while training the sheet P on the peripheral surface thereof (conveys the one sheet P by one rotation). The rotating of the processing liquid applying drum 42 and the sheet feeding drum 40 are controlled such that the timings of the receiving and the transferring of the sheet P to and from one another match. Namely, the processing liquid applying drum 42 and the sheet feeding drum 40 are driven so as to become the same peripheral speed, and are driven such that the positions of the grippers thereof match.

The processing liquid applying unit 44 coats, by a roller, the processing liquid onto the obverse of the sheet P conveyed by the processing liquid applying drum 42. This processing liquid applying unit 44 is structured mainly by a coating roller 44A that coats the processing liquid onto the sheet P, a processing liquid tank 44B in which the processing liquid is stored, and a draw-up roller 44C that draws-up the processing liquid stored in the processing liquid tank 44B and supplies the processing liquid to the coating roller 44A. The draw-up roller 44C is set so as to press and abut the coating roller 44A, and is set such that a portion of the draw-up roller 44C is submerged in the processing liquid that is stored in the processing liquid tank 44B. This draw-up roller 44C measures-out and draws-up the processing liquid, and applies the processing liquid at a uniform thickness onto the peripheral surface of the coating roller 44A. The coating roller 44A is provided so as to correspond to the sheet width, and is pressed and abutted against the sheet P, and coats the processing liquid, that has been applied on the peripheral surface thereof, onto the sheet P. The coating roller 44A is driven by an unillustrated abutting/separating mechanism, and moves between an abutting position of abutting the peripheral surface of the processing liquid applying drum 42, and a separated position of being separated from the peripheral surface of the processing liquid applying drum 42. The abutting/separating mechanism moves the coating roller 44A in accordance with the timing of the passage of the sheet P, and coats the processing liquid onto the obverse of the sheet P that is conveyed by the processing liquid applying drum 42.

Note that the present example is structured so as to coat the processing liquid by a roller, but the method of applying the processing liquid is not limited to this. Other than this, a structure that applies the processing liquid by using an inkjet head or a structure that applies the processing liquid by spraying can also be employed.

The processing liquid applying section 14 is structured as described above. The sheet P, that has been transferred from the sheet feeding drum 40 of the sheet feeding section 12, is received at the processing liquid applying drum 42. Due to the processing liquid applying drum 42 grasping the leading end of the sheet P by the gripper 42A and rotating, the processing liquid applying drum 42 trains the sheet P around the peripheral surface thereof and conveys the sheet P. In this conveying process, the coating roller 44A is pressed and abutted against the obverse of the sheet P, and the processing liquid is coated on the obverse of the sheet P.

Here, as the processing liquid that is coated on the obverse of this sheet P, a processing liquid, that has the function of agglomerating the color materials within the aqueous UV inks that are ejected onto the sheet P at the image recording section 18 that is a later stage, is coated. By coating such a processing liquid onto the obverse of the sheet P and ejecting drops of the aqueous UV inks thereon, high quality printing can be carried out without causing drop impact interference or the like, even when using general printing sheets.

<Processing Liquid Drying Processing Section>

The processing liquid drying processing section 16 carries out drying processing on the sheet P to whose obverse the processing liquid has been applied. This processing liquid drying processing section 16 is mainly structured by a processing liquid drying processing drum 46 that conveys the sheet P, a sheet conveying guide 48, and processing liquid drying processing units 50 that blow hot air out onto the printing surface of the sheet P conveyed by the processing liquid drying processing drum 46, and dry the printing surface.

The processing liquid drying processing drum 46 receives the sheet P from the processing liquid applying drum 42 of the processing liquid applying section 14, and conveys the sheet P to the image recording section 18. The processing liquid drying processing drum 46 is structured by a frame body that is built in a cylindrical shape, and is driven by an unillustrated motor and rotates. Grippers 46A are provided on the outer peripheral surface of the processing liquid drying processing drum 46, and the leading end of the sheet P is grasped by the gripper 46A. Due to the processing liquid drying processing drum 46 rotating while grasping the leading end of the sheet P by this gripper 46A, the processing liquid drying processing drum 46 conveys the sheet P to the image recording section 18. Note that the processing liquid drying processing drum 46 of the present example is structured such that the grippers 46A are disposed at two places on the outer peripheral surface, and two of the sheets P can be conveyed by one rotation. The rotating of the processing liquid drying processing drum 46 and the processing liquid applying drum 42 are controlled such that the timings of the receiving and the transferring of the sheet P to and from one another match. Namely, the processing liquid drying processing drum 46 and the processing liquid applying drum 42 are driven so as to become the same peripheral speed, and are driven such that the positions of the grippers thereof match.

The sheet conveying guide 48 is disposed along the conveying path of the sheet P by the processing liquid drying processing drum 46, and guides the conveying of the sheet P.

The processing liquid drying processing units 50 are disposed at the inner side of the processing liquid drying processing drum 46, and blow hot air out toward the obverse of the sheet P conveyed by the processing liquid drying processing drum 46, and carry out drying processing. In the present example, the two processing liquid drying processing units 50 are disposed within the processing liquid drying processing drum, and are structured to blow hot air out toward the obverse of the sheet P conveyed by the processing liquid drying processing drum 46.

The processing liquid drying processing section 16 is structured as described above. The sheet P, that has been transferred from the processing liquid applying drum 42 of the processing liquid applying section 14, is received at the processing liquid drying processing drum 46. The processing liquid drying processing drum 46 conveys the sheet P by grasping the leading end of the sheet P by the gripper 46A and rotating. At this time, the processing liquid drying processing drum 46 conveys the sheet P with the obverse of the sheet P (the surface on which the processing liquid was coated) facing toward the inner side. In the process of the sheet P being conveyed by the processing liquid drying processing drum 46, hot air is blown-out from the processing liquid drying processing units 50, that are set at the inner side of the processing liquid drying processing drum 46, onto the obverse of the sheet P, and the sheet P is subjected to drying processing. Namely, the solvent component within the processing liquid is removed. Due thereto, an ink agglomerating layer is formed on the obverse of the sheet P.

<Image Recording Section>

The image recording section 18 ejects liquid drops of inks (aqueous UV inks) of the respective colors of C, M, Y, K onto the printing surface of the sheet P, and draws a color image on the printing surface of the sheet P. This image recording section 18 is structured mainly by an image recording drum 52 that conveys the sheet P, a sheet pressing roller 54 that presses the sheet P that is conveyed by the image recording drum 52 and causes the sheet P to fit tightly to the peripheral surface of the image recording drum 52, inkjet heads 56C, 56M, 56Y, 56K that serve as examples of ejection heads that eject ink drops of the respective colors of C, M, Y, K onto the sheet P, an inline sensor 58 that reads-out the image recorded on the sheet P, a mist filter 60 that traps ink mist, and a drum cooling unit 62.

The image recording drum 52 receives the sheet P from the processing liquid drying processing drum 46 of the processing liquid drying processing section 16, and conveys the sheet P to the ink drying processing section 20. The image recording drum 52 is formed in a cylindrical shape, and is driven by an unillustrated motor and rotates. Grippers 52A are provided on the outer peripheral surface of the image recording drum 52, and the leading end of the sheet P is grasped by the gripper 52A. Due to the image recording drum 52 grasping the leading end of the sheet P by the gripper 52A and rotating, the image recording drum 52 conveys the sheet P to the ink drying processing section 20 while training the sheet P around the peripheral surface. Further, numerous suction holes (not illustrated) are formed in a predetermined pattern in the peripheral surface of the image recording drum 52. Due to the sheet P, that is trained around the peripheral surface of the image recording drum 52, being sucked from these suction holes, the sheet P is conveyed while being sucked and held at the peripheral surface of the image recording drum 52. Due thereto, the sheet P can be conveyed with good smoothness.

Note that the suction from these suction holes is applied only in a given range, and is applied from a predetermined suction start position to a predetermined suction end position. The suction start position is set at the set position of the sheet pressing roller 54, and the suction end position is set at the downstream side of the set position of the inline sensor 58 (e.g., is set at the position where the sheet is transferred to the ink drying processing section 20). Namely, the suction holes are set such that the sheet P is sucked and held at the peripheral surface of the image recording drum 52 at least at the set positions of the inkjet heads 56C, 56M, 56Y, 56K (the image recording positions) and the set position of the inline sensor 58 (the image read-out position).

Note that the mechanism for sucking and holding the sheet P at the peripheral surface of the image recording drum 52 is not limited to the above-described suction method by negative pressure, and a method in accordance with static electricity attraction also can be employed.

Further, the image recording drum 52 of the present example is structured such that the grippers 52A are disposed at two places on the outer peripheral surface thereof, and such that two of the sheets P can be conveyed by one rotation. Rotation of the image recording drum 52 and the processing liquid drying processing drum 46 are controlled such that the timings of the transferring and the receiving of the sheet P to and from one another match. Namely, the image recording drum 52 and the processing liquid drying processing drum 46 are driven so as to become the same peripheral speed, and are driven such that the positions of the grippers thereof match.

The sheet pressing roller 54 is disposed in a vicinity of the sheet receiving position of the image recording drum 52 (the position where the sheet P is received from the processing liquid drying processing drum 46). This sheet pressing roller 54 is structured by a rubber roller, and is set so as to be pressed against and made to abut the peripheral surface of the image recording drum 52. The sheet P, that has been transferred from the processing liquid drying processing drum 46 to the image recording drum 52, is nipped by passing by this sheet pressing roller 54, and is made to fit tightly to the peripheral surface of the image recording drum 52.

The four inkjet heads 56C, 56M, 56Y, 56K are disposed at a uniform interval along the conveying path of the sheet P by the image recording drum 52. These inkjet heads 56C, 56M, 56Y, 56K are structured by line heads corresponding to the sheet width, and are disposed such that the nozzle surfaces thereof face the peripheral surface of the image recording drum 52. The respective inkjet heads 56C, 56M, 56Y, 56K record an image onto the sheet P that is conveyed by the image recording drum 52, by ejecting drops of the inks toward the image recording drum 52 from nozzle rows that are formed at the nozzle surfaces.

Note that, as described above, aqueous UV inks are used as the inks that are ejected from the respective inkjet heads 56C, 56M, 56Y, 56K. The aqueous UV inks can be cured due to ultraviolet rays (UV) being irradiated thereon after ejection.

The inline sensor 58 is set at the downstream side of the final inkjet head 56K with respect to the conveying direction of the sheet P by the image recording drum 52, and reads-out the image recorded by the inkjet heads 56C, 56M, 56Y, 56K. This inline sensor 58 is structured by, for example, a line scanner, and reads-out the image that was recorded by the inkjet heads 56C, 56M, 56Y, 56K, from the sheet P that is conveyed by the image recording drum 52.

A contact preventing plate 59 is set adjacent to the inline sensor 58 at the downstream side of the inline sensor 58. This contact preventing plate 59 prevents the sheet P from contacting the inline sensor 58 when floating-up arises at the sheet P due to problems with conveying or the like.

The mist filter 60 is disposed between the final inkjet head 56K and the inline sensor 58, and sucks air at the periphery of the image recording drum 52 and traps ink mist. By sucking air at the periphery of the image recording drum 52 and trapping ink mist in this way, penetration of ink mist into the inline sensor 58 can be prevented, and the occurrence of reading defects and the like can be prevented.

The drum cooling unit 62 blows cold air out onto the image recording drum 52, and cools the image recording drum 52. This drum cooling unit 62 is structured mainly by an air conditioner (not illustrated), and a duct 62A that blows cold air, that is supplied from the air conditioner, out onto the peripheral surface of the image recording drum 52. The duct 62A blows cold air out onto a region of the image recording drum 52 other than the conveying region of the sheet P, and cools the image recording drum 52. In the present example, because the sheet P is conveyed along the circular-arc-shaped surface of the substantially upper half of the image recording drum 52, the duct 62A is structured so as to blow cold air out onto the region at the substantially lower half of the image recording drum 52 and cool the image recording drum 52. Concretely, the blow-out port of the duct 62A is formed in a circular arc shape so as to cover the substantially lower half of the image recording drum 52, and is structured such that cold air is blown-out onto the region at the substantially lower half of the image recording drum 52.

Here, the temperature of cooling the image recording drum 52 is determined by the relationship with the temperature of the inkjet heads 56C, 56M, 56Y, 56K (the temperature of the nozzle surfaces in particular), and is cooled so as to become a temperature that is lower than the temperature of the inkjet heads 56C, 56M, 56Y, 56K. Due thereto, condensation arising at the inkjet heads 56C, 56M, 56Y, 56K can be prevented. Namely, by making the temperature of the image recording drum 52 be lower than the inkjet heads 56C, 56M, 56Y, 56K, condensation can be brought about at the image recording drum side, and condensation that arises at the inkjet heads 56C, 56M, 56Y, 56K (in particular, condensation that arises at the nozzle surfaces) can be prevented.

The image recording section 18 is structured as described above. The sheet P, that has been transferred from the processing liquid drying processing drum 46 of the processing liquid drying processing section 16, is received at the image recording drum 52. The image recording drum 52 conveys the sheet P by grasping the leading end of the sheet P by the gripper 52A and rotating. Due to the sheet P, that has been transferred to the image recording drum 52, first passing by the sheet pressing roller 54, the sheet P is made to fit tightly to the peripheral surface of the image recording drum 52. Simultaneously therewith, the sheet P is sucked from the suction holes of the image recording drum 52, and is sucked and held on the outer peripheral surface of the image recording drum 52. The sheet P is conveyed in this state, and passes by the respective inkjet heads 56C, 56M, 56Y, 56K. Then, the drops of the inks of the respective colors of C, M, Y, K are ejected onto the obverse of the sheet P from the respective inkjet heads 56C, 56M, 56Y, 56K at the time when the sheet P passes by, and a color image is drawn on the obverse of the sheet P. Because the ink agglomerating layer is formed on the obverse of the sheet P, a high-quality image can be recorded without feathering or bleeding or the like being caused.

The sheet P, on which an image has been recorded by the inkjet heads 56C, 56M, 56Y, 56K, next passes by the inline sensor 58. Then, at the time of passing by this inline sensor 58, the image that has been recorded on the obverse of the sheet P is read-out. This reading-out of the recorded image is carried out as needed, and inspection of ejection defects and the like is carried out from the read-out image. At the time of carrying out reading-out, the reading-out is carried out in the state in which the sheet P is sucked and held at the image recording drum 52, and therefore, reading-out can be carried out highly precisely. Further, because reading-out is carried out immediately after image recording, abnormalities such as, for example, ejection defects and the like can be detected immediately, and can be dealt with rapidly. Due thereto, wasteful recording can be prevented, and the generating of waste paper can be kept to a minimum.

Thereafter, the sucking of the sheet P to the image recording drum 52 is cancelled, and thereafter, the sheet P is transferred to the ink drying processing section 20.

<Ink Drying Processing Section>

Figure 2:
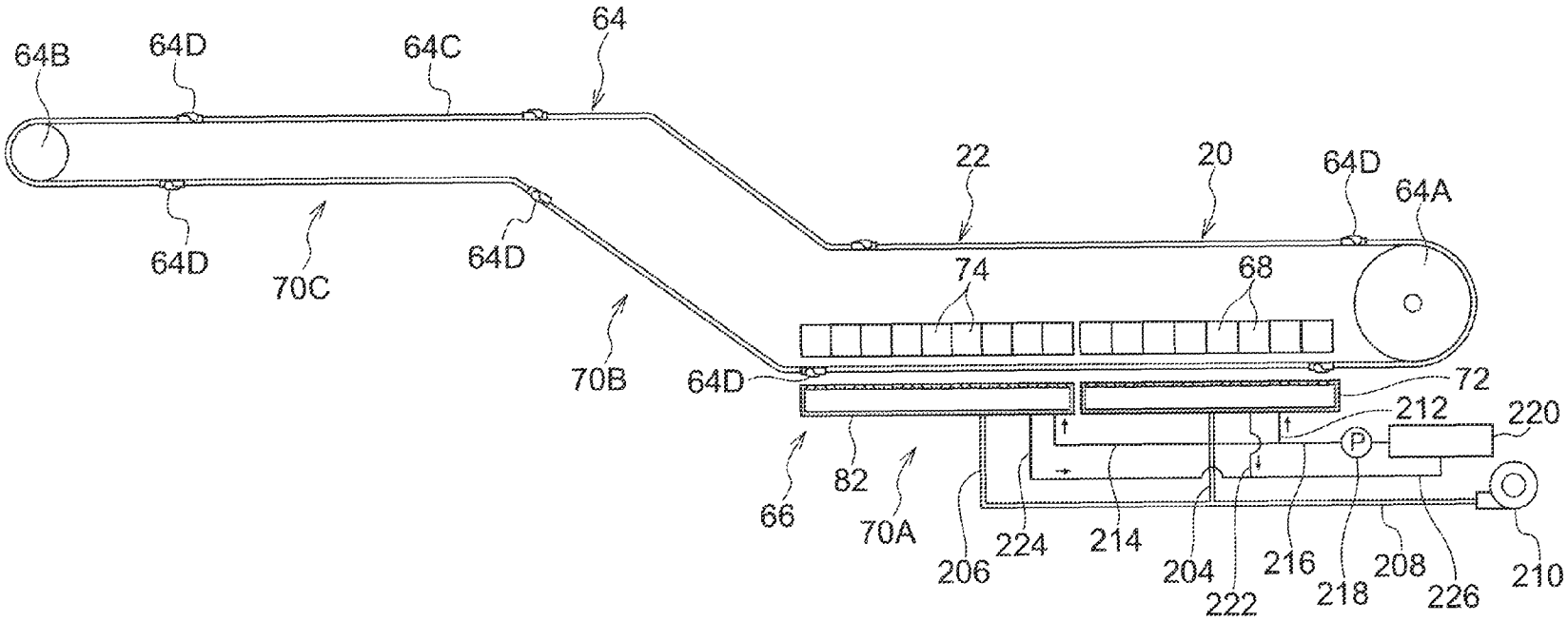
FIG. 2 is a side view showing the vicinity of a chain gripper, an ink drying processing section and a UV irradiating processing section that are used in the image forming device shown in FIG. 1.

As shown in FIG. 1 and FIG. 2, the ink drying processing section 20 carries out drying processing of the sheet P after image recording, and removes the liquid component remaining on the obverse of the sheet P. The ink drying processing section 20 is mainly structured by a chain gripper 64 that serves as an example of a conveying mechanism that conveys the sheet P on which the image has been recorded, a back tension applying mechanism (suction mechanism) 66 that applies back tension to the sheet P conveyed by the chain gripper 64, and ink drying processing units 68 that serve as an example of a drying device that carries out drying processing of the sheet P conveyed by the chain gripper 64.

The chain gripper 64 is a sheet conveying mechanism that is used in common at the ink drying processing section 20, the UV irradiating section 22 and the sheet discharging section 24, and receives the sheet P that has been transferred from the image recording section 18, and conveys the sheet P to as far as the sheet discharging section 24.

This chain gripper 64 is mainly structured by first sprockets 64A that are set adjacent to the image recording drum 52, second sprockets 64B that are set at the sheet discharging section 24, chains 64C that are endless and are trained around the first sprockets 64A and the second sprockets 64B, plural chain guides (not illustrated) that guide the traveling of the chains 64C, and plural grippers 64D that are mounted to the chains 64C at a uniform interval. The first sprockets 64A, the second sprockets 64B, the chains 64C, and the chain guides are respectively structured as pairs, and are disposed at both sides in the transverse direction of the sheet P. The grippers 64D are set so as to bridge over the chains 64C that are provided as a pair.

The first sprockets 64A are set adjacent to the image recording drum 52 such that the sheet P that has been transferred from the image recording drum 52 can be received by the gripper 64D. The first sprockets 64A are axially supported by unillustrated bearings, and are provided so as to rotate freely, and an unillustrated motor is connected thereto. The chains 64C that are trained around the first sprockets 64A and the second sprockets 64B travel due to this motor being driven.

The second sprockets 64B are set at the sheet discharging section 24 such that the sheet P that is received from the image recording drum 52 can be collected at the sheet discharging section 24. Namely, the positions at which these second sprockets 64B are set are made to be the final end of the conveying path of the sheet P by the chain gripper 64. These second sprockets 64B are axially supported by unillustrated bearings, and are provided so as to rotate freely.

The chains 64C are formed in endless forms, and are trained around the first sprockets 64A and the second sprockets 64B.

The chain guides are disposed at predetermined positions and guide the chains 64C such that the chains 64C travel on a predetermined path (=guide the chains 64C such that the sheet P travels and is conveyed on a predetermined conveying path). In the inkjet recording device 10 of the present example, the second sprockets 64B are set at a position that is higher than the first sprockets 64A. Therefore, a traveling path at which the chains 64C are inclined midway therealong is formed. Concretely, the traveling path is structured by a first horizontal conveying path 70, an inclined conveying path 70B, and a second horizontal conveying path 70C.

The first horizontal conveying path 70A is set at the same height as the first sprockets 64A, and is set such that the chains 64C that are trained around the first sprockets 64A travel horizontally. The second horizontal conveying path 70C is set at the same height as the second sprockets 64B, and is set such that the chains 64C that are trained around the second sprockets 64B travel horizontally. The inclined conveying path 70B is set between the first horizontal conveying path 70A and the second horizontal conveying path 70C, and is set so as to connect the first horizontal conveying path 70A and the second horizontal conveying path 70C.

The chain guides are disposed so as to form the first horizontal conveying path 70A, the inclined conveying path 70B and the second horizontal conveying path 70C. Concretely, the chain guides are disposed at least at the joining point of the first horizontal conveying path 70A and the inclined conveying path 70B, and at the joining point of the inclined conveying path 70B and the second horizontal conveying path 70C.

The plural grippers 64D are mounted to the chains 64C at a uniform interval. The interval at which these grippers 64D are mounted is set so as to accord with the interval of receiving the sheets P from the image recording drum 52. Namely, the mounting interval is set so as to accord with the interval of receiving the sheets P from the image recording drum 52, such that the sheets P that are transferred successively from the image recording drum 52 can be received from the image recording drum 52 with the timings matching.

The chain gripper 64 is structured as described above. As described above, when the motor (not illustrated) that is connected to the first sprockets 64A is driven, the chains 64C travel. The chains 64C travel at the same speed as the peripheral speed of the image recording drum 52. Further, the timings are made to match such that the sheets P that are transferred from the image recording drum 52 are received at the respective grippers 64D.

The back tension applying mechanism 66 applies back tension to the sheet P that is conveyed while the leading end thereof is grasped by the chain gripper 64. This back tension applying mechanism 66 mainly has a first guide plate 72 that serves as an example of a suction plate and that is disposed at the ink drying processing section 20, and a second guide plate 82 that serves as an example of a suction plate and that is disposed at the UV irradiating processing section 22.

Figure 3:
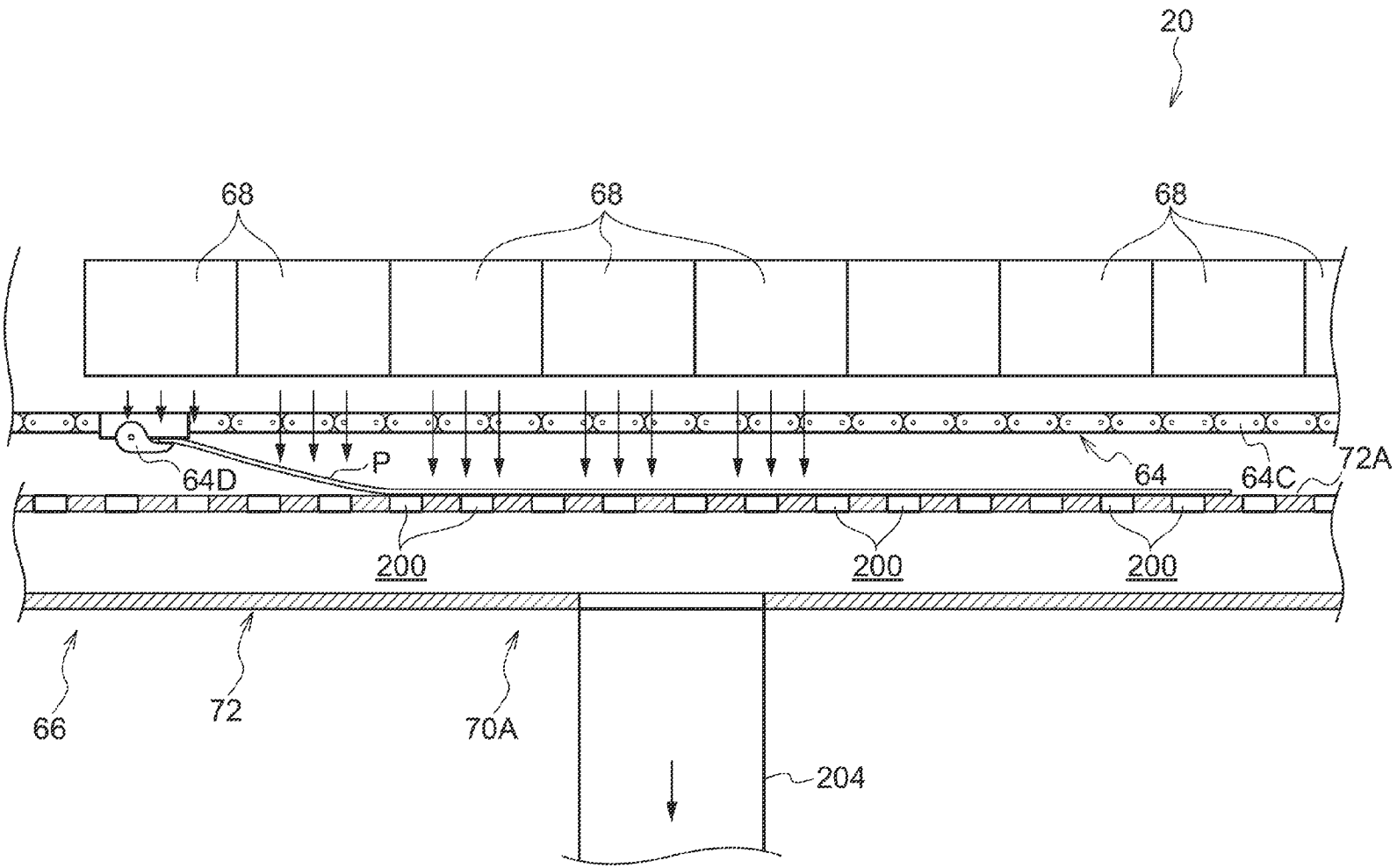
FIG. 3 is an enlarged sectional view showing the vicinity of a suction plate and the chain gripper that are used in the image forming device shown in FIG. 1.

As shown in FIG. 2 and FIG. 3, the first guide plate 72 is structured by a boxy plate that is hollow and has a width that corresponds to the sheet width. The first guide plate 72 has numerous suction holes 200 that are formed in a top surface 72A that serves as a surface of contact with the sheet P. A pipe 204 is connected to the bottom surface portion of the first guide plate 72 (see FIG. 3). As shown in FIG. 2, similarly, the second guide plate 82 also is structured by a boxy plate that is hollow and has a width that corresponds to the sheet width, and has numerous suction holes that are formed in the top surface (a surface of contact with the sheet P). A pipe 206 is connected to the bottom surface portion of the second guide plate 82.

The pipe 204 and the pipe 206 merge with a main pipe 208, and a suction blower 210 is provided at the downstream side of the main pipe 208 (see FIG. 2). Air is sucked by the suction blower 210 from the suction holes 200 of the first guide plate 72 and the suction holes of the second guide plate 82, and the sheet P is sucked onto the first guide plate 72 and onto the second guide plate 82.

As shown in FIG. 2 and FIG. 3, the first guide plate 72 is disposed along the conveying path of the sheet P by the chain gripper 62 (=the traveling path of the chains). Concretely, the first guide plate 72 is disposed along the chains 64C that travel along the front half portion of the first horizontal conveying path 70A, and is disposed so as to be separated by a predetermined distance from the chains 64C. Further, the second guide plate 82 is disposed along the chains 64C that travel along the rear half portion of the first horizontal conveying path 70A, and is disposed so as to be separated by a predetermined distance from the chains 64C. The sheet P that is conveyed by the chain gripper 64 is conveyed while the reverse surface (the surface at the side at which the image is not recorded) of the sheet P slidingly contacts the top surface 72A of the first guide plate 72 and the top surface of the second guide plate 82 (the surfaces facing the chains 64C: sliding contact surfaces).

As shown in FIG. 3, the numerous suction holes 200 are formed in a predetermined pattern in the top surface 72A (the sliding contact surface) of the first guide plate 72. The arrangement of the numerous suction holes 200 is described in detail later. As described above, the first guide plate 72 is formed by a boxy plate that is hollow, and the hollow portion (the interior) of the first guide plate 72 is sucked by the suction blower 210, and air is sucked from the suction holes 200 that are formed in the top surface 72A (the sliding contact surface).

Due to air being sucked from the suction holes 200 of the first guide plate 72, the reverse surface of the sheet P that is conveyed by the chain gripper 64 is sucked by the suction holes 200. Due thereto, back tension is applied to the sheet P that is conveyed by the chain gripper 64. At the second guide plate 82 as well, similarly, the reverse surface of the sheet P that is conveyed by the chain gripper 64 is sucked by the suction holes, and back tension is applied to the sheet P that is conveyed by the chain gripper 64.

As described above, because the first guide plate 72 and the second guide plate 82 are disposed along the chains 64C that travel along the first horizontal conveying path 70A, back tension is applied while the sheet P is being conveyed on the first horizontal conveying path 70A.

As shown in FIG. 2, an introduction pipe 212 through which cooling liquid is introduced is connected to the lower portion of the first guide plate 72. A circulation flow path (not illustrated), through which the cooling liquid from the introduction pipe 212 flows, is provided at the interior of the first guide plate 72. The circulation flow path (not illustrated) is disposed so as to meander substantially uniformly through the interior of the first guide plate 72. Similarly, an introduction pipe 214 through which cooling liquid flows is connected to the lower portion of the second guide plate 82, and a circulation flow path (not illustrated), through which the cooling liquid from the introduction pipe 214 flows, is provided at the interior of the second guide plate 82.

The introduction pipe 212 and the introduction pipe 214 are branched-off from a main pipe 216. The main pipe 216 is connected via a pump 218 to a chiller 220 that serves as an example of a cooling liquid circulating device. Due thereto, due to driving of the pump 218, cooling liquid is made to flow from the chiller 220 to the main pipe 216, and the cooling liquid is supplied from the main pipe 216 via the introduction pipe 212 to the circulation flow path (not illustrated) of the first guide plate 72 as shown by the arrow. Similarly, cooling liquid is supplied from the main pipe 216 via the introduction pipe 214 to the circulation flow path (not illustrated) of the second guide plate 82 as shown by the arrow. Then, due to the cooling liquid flowing through the circulation flow path of the first guide plate 72, at least the top surface 72A side of the first guide plate 72 is cooled. Further, due to the cooling liquid flowing through the circulation flow path of the second guide plate 82, at least the top surface side of the second guide plate 82 is cooled.

A discharge pipe 222, to which the cooling liquid of the circulation flow path (not illustrated) is discharged, is connected to the lower portion of the first guide plate 72. A discharge pipe 224, to which the cooling liquid of the circulation flow path (not illustrated) is discharged, is connected to the lower portion of the second guide plate 82. The discharge pipe 222 and the discharge pipe 224 merge with a main pipe 226, and moreover, the main pipe 226 is connected to the chiller 220. Due thereto, cooling liquid is discharged into the discharge pipe 222 from the circulation flow path (not illustrated) of the first guide plate 72 as shown by the arrow, and the cooling liquid flows into the main pipe 226. Further, similarly, cooling liquid is discharged into the discharge pipe 224 from the circulation flow path (not illustrated) of the second guide plate 82 as shown by the arrow, and the cooling liquid flows into the main pipe 226. The cooling liquid that is merged at the main pipe 226 is recovered by the chiller 220. Namely, as shown by the arrows in FIG. 2, the cooling liquid is controlled to be a predetermined temperature by the chiller 220, and the cooling liquid is circulatingly sent to the first guide plate 72 and the second guide plate 82.

Water (spring water, pure water), an ethylene glycol aqueous solution (antifreeze liquid) or the like can be used as the cooling liquid.

As shown in FIG. 2, the ink drying processing units 68 are set within the chain gripper 64 (in particular, at the front half side of the region that structures the first horizontal conveying path 70A), and carry out drying processing on the sheet P that is conveyed on the first horizontal conveying path 70A. Namely, the ink drying processing section 20 is a mechanism that dries the moisture that is contained in the solvent that separated due to the color material agglomerating action. At the ink drying processing section 20, the ink drying processing units 68, in which plural combinations of fans and IR heaters or the like are disposed, are provided at positions facing the sheet P that is conveyed by the chain gripper 64. The ink drying processing units 68 blow hot air out onto the obverse of the sheet P that is conveyed on the first horizontal conveying path 70A, and carry out drying processing. The plural ink drying processing units 68 are disposed along the first horizontal conveying path 70A. The number of the ink drying processing units 68 that are set is set in accordance with the processing capability of the ink drying processing units 68, the conveying speed of the sheet P (=the printing speed), and the like. Namely, the number of the ink drying processing units 68 that are set is set such that the sheet P that has been received from the image recording section 18 can be dried while being conveyed on the first horizontal conveying path 70A. Accordingly, the length of the first horizontal conveying path 70A as well is set in consideration of the capability of these ink drying processing units 68.

The ink drying processing section 20 is structured as described above. The sheet P, that has been transferred from the image recording drum 52 of the image recording section 18, is received at the chain gripper 64. The chain gripper 64 grasps the leading end of the sheet P by the gripper 64D, and conveys the sheet P along the first guide plate 72 that is planar. The sheet P that has been transferred to the chain gripper 64 is first conveyed on the first horizontal conveying path 70A. In the process of being conveyed on this first horizontal conveying path 70A, the sheet P is subjected to drying processing by the ink drying processing units 68 that are set at the interior of the chain gripper 64. Namely, hot air is blown-out onto the obverse (the image recording surface) of the sheet P, and drying processing is carried out. At this time, the sheet P is subjected to the drying processing while back tension is applied thereto by the back tension applying mechanism 66. Due thereto, drying processing can be carried out while deformation of the sheet P is suppressed.

At the ink drying processing section 20, due to cooling liquid being supplied from the chiller 220 to the first guide plate 72 and the cooling liquid being circulated in the circulation flow path (not illustrated) of the first guide plate 72, the top surface 72A of the first guide plate 72 becoming an excessively high temperature is suppressed.

<UV Irradiating Processing Section>

The UV irradiating processing section 22 irradiates ultraviolet rays (UV) onto the image that was recorded by using the aqueous UV inks, and fixes the image. This UV irradiating processing section 22 is mainly structured by the chain gripper 64 that conveys the sheet P, the back tension applying mechanism 66 that applies back tension to the sheet P conveyed by the chain gripper 64, and UV irradiating units 74 that serve as an example of a liquid drop curing device and that irradiate ultraviolet rays onto the sheet P that is conveyed by the chain gripper 64.

As described above, the chain gripper 64 and the back tension applying mechanism 66 are used in common at the ink drying processing section 20 and the sheet discharging section 24 as well.

The UV irradiating units 74 are set at the interior of the chain gripper 64 (the rear half side of the region that structures the first horizontal conveying path 70A), and irradiate ultraviolet rays onto the obverse of the sheet P conveyed on the first horizontal conveying path 70A. The UV irradiating units 74 have ultraviolet ray lamps (UV lamps), and the plural UV irradiating units 74 are disposed along the first horizontal conveying path 70A. Further, the UV irradiating units 74 irradiate ultraviolet rays toward the obverse of the sheet P that is conveyed on the first horizontal conveying path 70A. The number of the UV irradiating units 74 that are set is set in accordance with the conveying speed of the sheet P (=the printing speed), and the like. Namely, the number of the UV irradiating units 74 that are set is set such that the image can be fixed by the ultraviolet rays that are irradiated while the sheet P is being conveyed on the first horizontal conveying path 70A. Accordingly, the length of the first horizontal conveying path 70A also is set in consideration of the conveying speed of the sheet P, and the like.

The UV irradiating processing section 22 is structured as described above. The sheet P, that has been conveyed by the chain gripper 64 and subjected to drying processing at the ink drying processing section 20, is conveyed on the first horizontal conveying path 70A. At the first horizontal conveying path 70A, the chain gripper 64 grasps the leading end of the sheet P by the gripper 64D, and conveys the sheet P along the second guide plate 82. In this process of being conveyed on the first horizontal conveying path 70A, the sheet P is subjected to UV irradiating processing by the UV irradiating units 74 that are set at the interior of the chain gripper 64. Namely, ultraviolet rays are irradiated from the UV irradiating units 74 toward the obverse of the sheet P. At this time, the sheet P is subjected to the UV irradiating processing while back tension is applied thereto by the back tension applying mechanism 66. Due thereto, UV irradiating processing can be carried out while deformation of the sheet P is suppressed.

At the UV irradiating processing section 22, due to cooling water being supplied from the chiller 220 to the second guide plate 82 and being circulated through the circulation flow path (not illustrated) at the interior of the first guide plate 82, the top surface of the second guide plate 82 becoming an excessively high temperature is suppressed.

<Sheet Discharging Section>

As shown in FIG. 1, the sheet discharging section 24 collects the sheets P on which the series of image recording processings have been carried out. This sheet discharging section 24 is mainly structured by the chain gripper 64 that conveys the sheet P that has been UV-irradiated, and a sheet discharging stand 76 that stacks and collects the sheets P.

As described above, the chain gripper 64 is used in common at the ink drying processing section 20 and the UV irradiating processing section 22 as well. The chain gripper 64 releases the sheets P onto the sheet discharging stand 76, and stacks the sheets P on the sheet discharging stand 76.

The sheet discharging stand 76 stacks and collects the sheets P that have been released from the chain gripper 64. Sheet abutters (a front sheet abutter, a rear sheet abutter, transverse sheet abutters, or the like) are provided (not illustrated) at this sheet discharging stand 76 so that the sheets P are stacked orderly.

Further, the sheet discharging stand 76 is provided so as to be able to be raised and lowered by an unillustrated sheet discharging stand raising/lowering device. The driving of the sheet discharging stand raising/lowering device is controlled interlockingly with the increase/decrease in the sheets P that are stacked in the sheet discharging stand 76, and the sheet discharging stand raising/lowering device raises and lowers the sheet discharging stand 76 such that the sheet P, that is positioned topmost, is always positioned at a constant height.

<Details of First Guide Plate and the Like that Serve as Suction Plates>

The first guide plate 72 and the second guide plate 82 of the inkjet recording device 10 of the present embodiment are described in further detail next.

Figure 4:
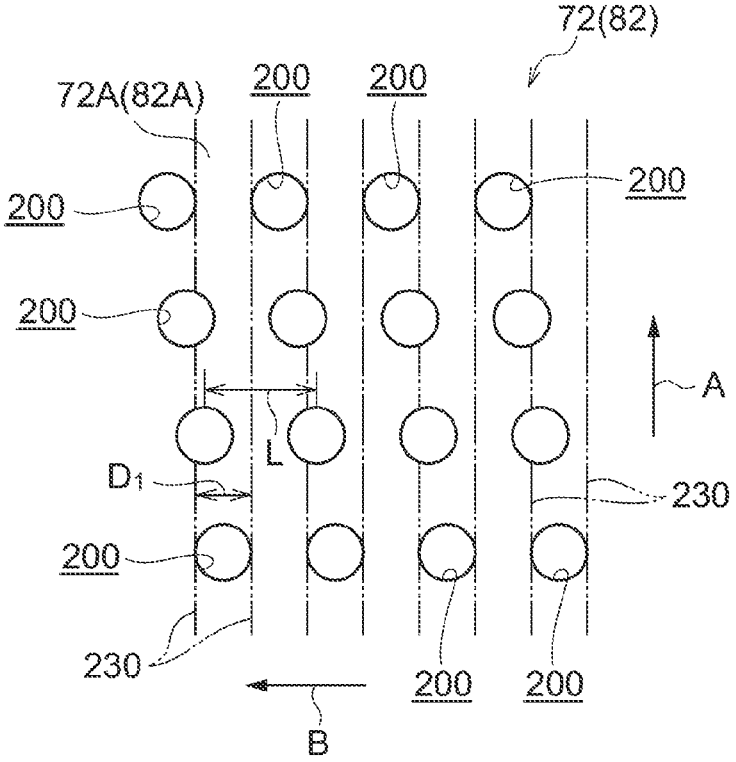
FIG. 4 is a plan view showing a portion of the suction plate that is used in the image forming device of the first embodiment.

A portion of the first guide plate 72 of the present embodiment is illustrated in a plan view in FIG. 4. The top surface 72A of the first guide plate 72 is made to be a contact surface (sliding contact surface) that the sheet P contacts (see FIG. 3). As shown in FIG. 4, the numerous suction holes 200 are formed in the top surface 72A of the first guide plate 72. In the present embodiment, the suction holes 200 are substantially circular, and the sizes of the suction holes 200 are set to be substantially uniform (substantially the same size). The sheet P (see FIG. 3) is conveyed in the arrow A direction while slidingly contacting the top surface 72A of the first guide plate 72. The suction holes 200 are disposed at the first guide plate 72 such that any one of the suction holes 200 exists in the direction (the arrow B direction, i.e., the transverse direction of the sheet P) orthogonal to the conveying direction of the sheet P, when the numerous suction holes 200 are projected in the conveying direction A of the sheet P. Due thereto, the sheet P that is conveyed is, while being conveyed at the first guide plate 72, made to be in a state in which there is no region thereof that is always contacting the top surface 72A of the first guide plate 72.

More concretely, there is a structure in which, when viewing, row-by-row, the hole rows of the suction holes 200 that run along the conveying direction A of the sheet P, with respect to one of the suction holes 200 that is a reference, the suction holes 200 that are adjacent to one another in the conveying direction A of the sheet P are offset in direction B, that is orthogonal to the conveying direction A of the sheet, by ⅓ of the hole diameter. For example, the one suction hole 200 that is the reference can be set at the suction hole 200 that is at the nearest side in FIG. 4. In other words, with respect to tangent lines 230 of the suction holes 200 (tangent lines that run along the conveying direction A of the sheet P), the suction holes 200 that are adjacent to one another in the conveying direction A of the sheet P are offset by ⅓ of the hole diameter, and further, this offset of ⅓ of the hole diameter is repeated at the suction holes 200 that are adjacent to one another in the conveying direction A of the sheet P. Further, with respect to the suction holes 200 that are the references along the transverse direction of the sheet (the arrow B direction), the third suction hole 200 in the conveying direction A of the sheet P is disposed between the suction holes 200 that are the references along the transverse direction of the sheet P.

The first guide plate 72 is structured such that the suction holes 200 that structure a hole row that runs along the conveying direction A of the sheet P are each offset in direction B, that is orthogonal to conveying direction A of the sheet P, by a uniform amount (⅓ of the hole diameter of the suction hole 200), and return to the original arrangement of the hole row periodically (at the position of the sixth suction hole 200 in the conveying direction A of the sheet P). Namely, the suction holes 200 that are adjacent to one another are disposed so as to overlap one another, when the numerous suction holes 200 are projected in the conveying direction A of the sheet P.

In the present embodiment, hole diameter D1 of the suction hole 200 is set to be, for example, approximately $\phi$ 10 μm, and the pitch of the suction holes 200 in direction B that is orthogonal to the conveying direction of the sheet P (distance L between the centers of the suction holes 200 that are adjacent to one another) is set to be, for example, approximately 20 μm.

Due thereto, when the sheet P is conveyed while contacting (slidingly contacting) the top surface 72A of the first guide plate 72, dispersion arising in the cumulative passage times of the sheet P at portions of the top surface 72A where the suction holes 200 are formed and portions where the suction holes 200 are not formed is reduced. Due thereto, the arising of differences in the temperature distribution at the time of drying the sheet P is suppressed.

Although not illustrated, the second guide plate 82 is structured substantially the same as the first guide plate 72, and the numerous suction holes 200 are arranged in the same pattern as the first guide plate 72.

Operation and effects of the inkjet recording device 10 are described next. As shown in FIG. 4, at the first guide plate 72, the suction holes 200 are disposed such that, when the numerous suction holes 200 are projected in the conveying direction A of the sheet P, any one of the suction holes 200 exists in direction B that is orthogonal to the conveying direction A of the sheet P. In the present embodiment, at the first guide plate 72, the suction holes 200, that structure a hole row that runs along the conveying direction A of the sheet P, are each offset in direction B, that is orthogonal to the conveying direction A of the sheet P, by a uniform amount (⅓ of the hole diameter of the suction hole 200), and return to the original arrangement of the hole row periodically (at the position of the sixth suction hole 200 in the conveying direction A of the sheet P). Due thereto, the sheet P that is conveyed is, while conveyed at the first guide plate 72, made to be in a state in which there is no region thereof that is always contacting the top surface 72A of the first guide plate 72 (a position where there are none of the suction holes 200).

Due thereto, when the sheet P is conveyed in the arrow A direction while contacting (slidingly contacting) the top surface 72A of the first guide plate 72, dispersion arising in the cumulative passage times of the sheet P at portions of the top surface 72A where the suction holes 200 are formed and portions where the suction holes 200 are not formed is reduced (the contact times of the sheet P with the top surface 72A of the first guide plate 72 are made to be more uniform). Therefore, when the sheet P onto which the inks have been ejected is conveyed on the top surface 72A of the first guide plate 72 and is subjected to drying processing by the ink drying processing units 68, the arising of differences in the temperature distribution of the sheet P is suppressed (see FIG. 3).

Thereafter, due to the sheet P being conveyed while contacting (slidingly contacting) the top surface 82A of the second guide plate 82 and UV irradiating processing being carried out by the UV irradiating units 74, the inks on the sheet P are cured. Plural suction holes are formed in the top surface 82A of the second guide plate 82 in the same pattern as the top surface 72A of the first guide plate 72. Due thereto, when the sheet P is conveyed while contacting the top surface 82A of the second guide plate 82, dispersion arising in the cumulative passage times of the sheet P at the portions of the top surface 82A where the suction holes 200 are formed and the portions where the suction holes 200 are not formed is reduced. Therefore, the arising of differences in the temperature distribution of the sheet P is suppressed, and the occurrence of non-uniformity of the image can be suppressed.

Further, as shown in FIG. 2, cooling liquid is circulatingly sent from the chiller 220 to the circulation flow paths (not illustrated) that are provided at the interiors of the first guide plate 72 and the second guide plate 82. Due thereto, the top surface 72A of the first guide plate 72 and the top surface 82A of the second guide plate 82 becoming excessively high temperatures is suppressed. At this time, by arranging the numerous suction holes 200 as described above (see FIG. 4), dispersion arising in the cumulative passage times of the sheet P at the portions of the top surfaces 72A, 82A where the suction holes 200 are formed and the portions where the suction holes 200 are not formed is reduced. Therefore, the arising of differences in the temperature distribution of the sheet P is suppressed, and the occurrence of non-uniformity of the image can be suppressed more reliably.

Figure 10:
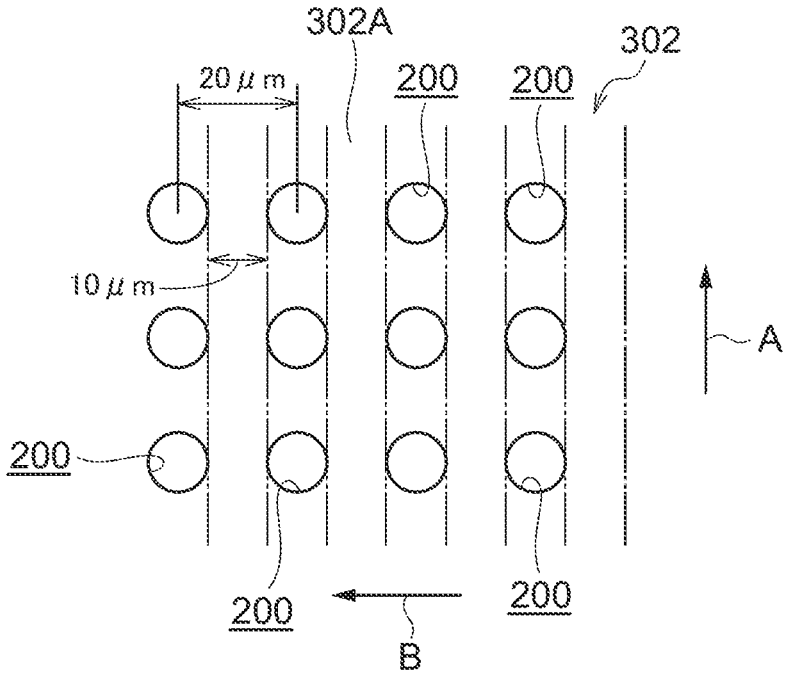
FIG. 10 is a plan view showing a portion of a suction plate that is used in an image forming device of a comparative example.

A portion of a first guide plate 302, that serves as a suction plate and that is used in an inkjet recording device of a comparative example, is shown in a plan view in FIG. 10. As shown in FIG. 10, the sheet P (not illustrated) is conveyed in the arrow A direction while contacting a top surface (contact surface) 302A of the first guide plate 302. At the top surface 302A of the first guide plate 302, the suction holes 200 are arranged at substantially uniform intervals along the conveying direction A of the sheet P, and the suction holes 200 are arranged at substantially uniform intervals along direction B that is orthogonal to the conveying direction of the sheet P.

In this comparative example, the hole diameter of the suction hole 200 is set to be, for example, approximately ϕ 10 μm. The pitch of the suction holes 200 in direction B that is orthogonal to the conveying direction of the sheet P (the distance between the centers of the suction holes 200 that are adjacent to one another) is set to be, for example, approximately 20 μm. The distance between the suction holes 200 in direction B that is orthogonal to the conveying direction of the sheet P is set to be, for example, approximately 10 μm.

In such a structure, when the sheet P is conveyed in the arrow A direction while contacting (slidingly contacting) the top surface 302A of the first guide plate 302, at the portions of the suction holes 200, the contact time between the top surface 302A of the first guide plate 302 and the sheet P is short, and, at the portions between the suction holes 200, the top surface 302A of the first guide plate 302 and the sheet P always contact. Therefore, when the sheet P is conveyed in the arrow A direction, a difference arises in the temperature distribution of the sheet P at the portions of the top surface 302A where the suction holes 200 are formed and the portions where the suction holes 200 are not formed, and therefore, the drying states differ, and there is the possibility that non-uniformity of the image will arise.

In contrast, at the first guide plate 72 of the present embodiment, when the sheet P is conveyed while contacting (slidingly contacting) the top surface 72A of the first guide plate 72, dispersion arising in the cumulative passage times of the sheet P at the portions of the top surface 72A where the suction holes 200 are formed and the portions where the suction holes 200 are not formed is reduced. Therefore, the arising of differences in the temperature distribution of the sheet P is suppressed, and the occurrence of non-uniformity of the image can be suppressed.

Other Embodiments

An inkjet recording device that serves as an image forming device relating to a second embodiment of the present invention is described next by using FIG. 5. Note that structural portions that are the same as the above-described first embodiment are denoted by the same numbers, and description thereof is omitted.

Figure 5:
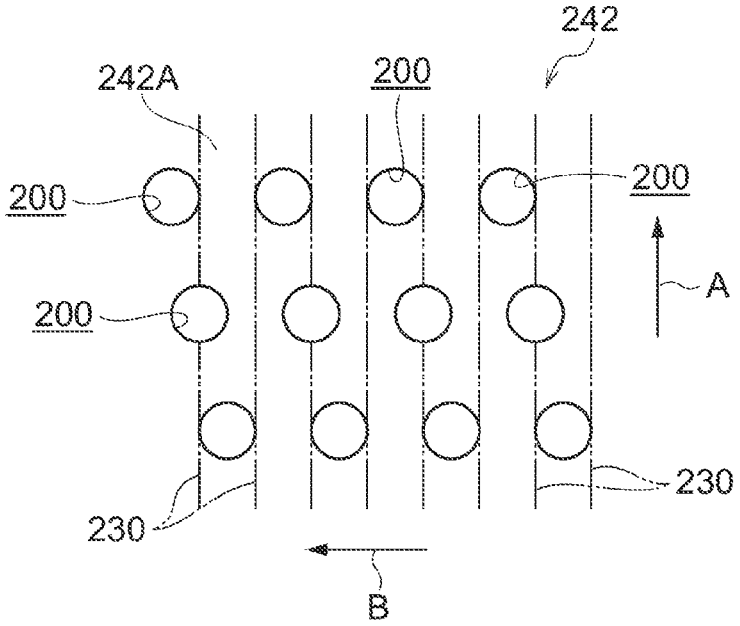
FIG. 5 is a plan view showing a portion of a suction plate that is used in an image forming device of a second embodiment.

A portion of a first guide plate 242, that serves as a suction plate and that is used in the inkjet recording device of the second embodiment, is shown in a plan view in FIG. 5. A top surface 242A of the first guide plate 242 is made to be the contact surface (sliding contact surface) on which the sheet P is conveyed in the arrow A direction while contacting (see FIG. 3). As shown in FIG. 5, the numerous suction holes 200 are formed in the top surface 242A of the first guide plate 242, and are disposed such that, when the numerous suction holes 200 are projected in the conveying direction A of the sheet P, any one of the suction holes 200 exists in direction B that is orthogonal to the conveying direction of the sheet P. Due thereto, the sheet P that is conveyed is made to be in a state in which there is no region thereof that is always contacting the top surface 242A of the first guide plate 242 (a position at which there are none of the suction holes 200).

More concretely, there is a structure in which, when viewing, row-by-row, the hole rows of the suction holes 200 that run along the conveying direction A of the sheet P, with respect to one of the suction holes 200 that is a reference (refer to the tangent lines 230), the suction holes 200 that are adjacent to one another in the conveying direction A of the sheet P are offset in direction B, that is orthogonal to the conveying direction of the sheet P, by ½ of the hole diameter. Further, with respect to the suction holes 200 that are the references along the transverse direction of the sheet P (the arrow B direction), the second suction hole 200 in the conveying direction A of the sheet P is disposed between the suction holes 200 that are the references along the transverse direction of the sheet P.

Namely, the first guide plate 242 is structured such that the suction holes 200 that structure a hole row that runs along the conveying direction A of the sheet P are each offset in direction B, that is orthogonal to the conveying direction of the sheet P, by a uniform amount (½ of the hole diameter of the suction hole 200), and return to the original arrangement of the hole row periodically (at the position of the fourth suction hole 200 in the conveying direction A of the sheet P). Namely, the suction holes 200 that are adjacent to one another are disposed so as to overlap one another, when the numerous suction holes 200 are projected in the conveying direction A of the sheet P.

Although not illustrated, the second guide plate is structured substantially the same as the first guide plate 242, and the numerous suction holes 200 are arranged in the same pattern as the first guide plate 242.

In such a structure, when the sheet P is conveyed in the arrow A direction while contacting (slidingly contacting) the top surface 242A of the first guide plate 242, dispersion arising in the cumulative passage times of the sheet P at the portions of the top surface 242A where the suction holes 200 are formed and the portions where the suction holes 200 are not formed is reduced (the contact times of the sheet P with the top surface 242A of the first guide plate 242 are made to be more uniform). Therefore, when the sheet P onto which the inks have been ejected is subjected to drying processing by the ink drying processing units 68 (see FIG. 2), the arising of differences in the temperature distribution of the sheet P is suppressed.

Thereafter, the sheet P is conveyed while contacting the top surface of the second guide plate, and UV irradiating processing is carried out by the UV irradiating units 74 (see FIG. 2). At this time, the plural suction holes 200 are formed in the top surface of the second guide plate in the same pattern as the top surface 242A of the first guide plate 242. Due thereto, dispersion arising in the cumulative passage times of the sheet P at the portions of the top surface 242A where the suction holes 200 are formed and the portions where the suction holes 200 are not formed is reduced. Therefore, the arising of differences in the temperature distribution of the sheet P is suppressed, and the occurrence of non-uniformity of the image can be suppressed.

An inkjet recording device that serves as an image forming device relating to a third embodiment of the present invention is described next by using FIG. 6. Note that structural portions that are the same as the above-described first and second embodiments are denoted by the same numbers, and description thereof is omitted.

Figure 6:
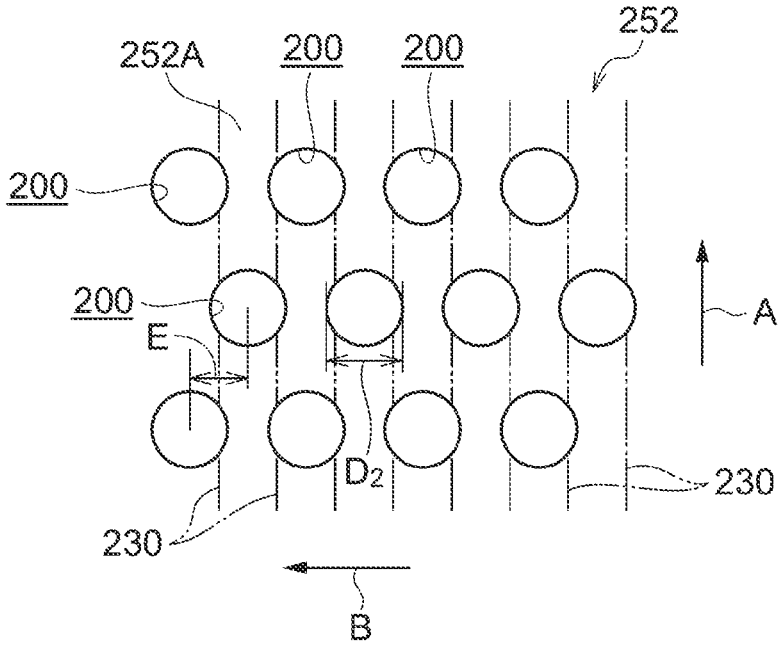
FIG. 6 is a plan view showing a portion of a suction plate that is used in an image forming device of a third embodiment.

A portion of a first guide plate 252, that serves as a suction plate and that is used in the inkjet recording device of the third embodiment, is shown in a plan view in FIG. 6. As shown in this drawing, the numerous suction holes 200 are formed in a top surface (sliding contact surface) 252A of the first guide plate 252, and are disposed such that, when the numerous suction holes 200 are projected in the conveying direction A of the sheet P, any one of the suction holes 200 exists in direction B that is orthogonal to the conveying direction of the sheet P. Due thereto, the sheet P that is conveyed is made to be in a state in which there is no region thereof that is always contacting the top surface 252A of the first guide plate 252 (a position at which there are none of the suction holes 200).

More concretely, when viewing, row-by-row, the hole rows of the suction holes 200 that run along the conveying direction A of the sheet P, with respect to one of the suction holes 200 that is a reference, the suction holes 200 that are adjacent to one another in the conveying direction A of the sheet P are offset in direction B, that is orthogonal to the conveying direction of the sheet, by a distance that is slightly shorter than the hole diameter. Due thereto, with respect to the suction holes 200 that are the references along the transverse direction of the sheet P (the arrow B direction), the suction holes 200 that are adjacent to one another in the conveying direction A of the sheet P are disposed between the suction holes 200 that are the references along the transverse direction of the sheet P.

In the present embodiment, hole diameter D2 of the suction hole 200 is set to be greater than ϕ 10 μm (e.g., approximately ϕ 12 μm). Distance E between the centers of the suction holes 200 that are adjacent to one another in direction B that is orthogonal to the conveying direction of the sheet P when the suction holes 200 are projected in the conveying direction A of the sheet P, is set to be, for example, approximately 10 μm. Namely, the suction holes 200 that are adjacent to one another are disposed so as to overlap one another when the numerous suction holes 200 are projected in the conveying direction A of the sheet P.

Although not illustrated, the second guide plate is structured substantially the same as the first guide plate 252, and the numerous suction holes 200 are arranged in the same pattern as the first guide plate 252.

In such a structure, when the sheet P is conveyed in the arrow A direction while contacting (slidingly contacting) the top surface 252A of the first guide plate 252, dispersion arising in the cumulative passage times of the sheet P at the portions of the top surface 252A where the suction holes 200 are formed and the portions where the suction holes 200 are not formed is reduced (the contact times of the sheet P with the top surface 252A of the first guide plate 252 are made to be more uniform). Therefore, when the sheet P onto which the inks have been ejected is subjected to drying processing by the ink drying processing units 68 (see FIG. 2), the arising of differences in the temperature distribution of the sheet P is suppressed.

Thereafter, the sheet P is conveyed while contacting the top surface of the second guide plate, and UV irradiating processing is carried out by the UV irradiating units 74 (see FIG. 2). At this time, the plural suction holes 200 are formed in the top surface of the second guide plate in the same pattern as the top surface 252A of the first guide plate 252. Due thereto, dispersion arising in the cumulative passage times of the sheet P at the portions of the top surface 252A where the suction holes 200 are formed and the portions where the suction holes 200 are not formed is reduced. Therefore, the arising of differences in the temperature distribution of the sheet P is suppressed, and the occurrence of non-uniformity of the image can be suppressed.

An inkjet recording device that serves as an image forming device relating to a reference example of the present invention is described next by using FIG. 7. Note that structural portions that are the same as the above-described first through third embodiments are denoted by the same numbers, and description thereof is omitted.

Figure 7:
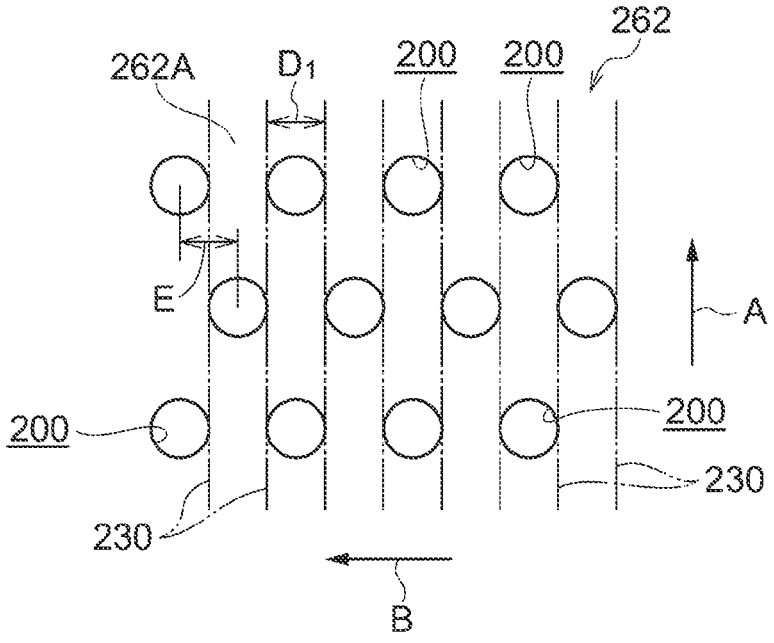
FIG. 7 is a plan view showing a portion of a suction plate that is used in an image forming device of a reference example.

A portion of a first guide plate 262, that serves as a suction plate and that is used in the inkjet recording device of the reference example, is shown in a plan view in FIG. 7. As shown in this drawing, the numerous suction holes 200 are formed in a top surface (sliding contact surface) 262A of the first guide plate 262, and are disposed such that, when the numerous suction holes 200 are projected in the conveying direction A of the sheet P, any one of the suction holes 200 exists in direction B that is orthogonal to the conveying direction of the sheet P. Due thereto, the sheet P that is conveyed is made to be in a state in which there is no region thereof that is always contacting the top surface 262A of the first guide plate 262.

More concretely, when viewing, row-by-row, the hole rows of the suction holes 200 that run along the conveying direction A of the sheet P, with respect to one of the suction holes 200 that is a reference, the suction holes 200 that are adjacent to one another in the conveying direction A of the sheet P are offset in direction B, that is orthogonal to the conveying direction of the sheet, by the hole diameter. Further, the suction holes 200 that run along the transverse direction of the sheet P (the arrow B direction) and that are positioned in the next row, are disposed between the suction holes 200 that run along the transverse direction of the sheet P (the arrow B direction).

At this first guide plate 262, the hole diameter D1 of the suction hole 200 is set to be, for example, approximately $\phi$ 10 μm. The distance E between the centers of the suction holes 200, that are adjacent to one another in direction B that is orthogonal to the conveying direction of the sheet P when the suction holes 200 are projected in the conveying direction A of the sheet P, is set to be, for example, approximately 10 μm.

At the first guide plate 262, there is a structure in which the suction holes 200 that are adjacent to one another contact one another, when the numerous suction holes 200 are projected in the conveying direction A of the sheet P.

Although not illustrated, the second guide plate is substantially the same structure as the first guide plate 262.

In such a structure, when the sheet P is conveyed in the arrow A direction while contacting (slidingly contacting) the top surface 262A of the first guide plate 262, as compared with the first guide plate 302 of the comparative example (see FIG. 10), dispersion arising in the cumulative passage times of the sheet P at the portions of the top surface 262A where the suction holes 200 are formed and the portions where the suction holes 200 are not formed can be reduced. Therefore, as compared with the first guide plate 302 of the comparative example (see FIG. 10), at the positions facing the ink drying processing units 68 (see FIG. 2) and the UV irradiating units 74 (see FIG. 2), the arising of differences in the temperature distribution of the sheet P is suppressed, and the occurrence of non-uniformity of the image can be suppressed.

However, at the first guide plate 262 of the present example, there is a structure in which, when the numerous suction holes 200 are projected in the conveying direction A of the sheet P, the suction holes 200 that are adjacent to one another contact one another on the tangent lines 230. Therefore, in a structure in which the suction holes 200 that are adjacent to one another are disposed so as to overlap one another when the numerous suction holes 200 are projected in the conveying direction A of the sheet P as in the first guide plate 252 shown in FIG. 6, the contact times between the sheet P and the first guide plate, including on the tangent lines 230, are made uniform more reliably. Accordingly, at the first guide plate 252 shown in FIG. 6, dispersion between the cumulative passage times of the sheet P at the portions of the top surface 252A where the suction holes 200 are formed and the portions where the suction holes 200 are not formed can be reduced more effectively.

An inkjet recording device that serves as an image forming device relating to a fourth embodiment of the present invention is described next by using FIG. 8. Note that structural portions that are the same as the above-described first through third embodiments are denoted by the same numbers, and description thereof is omitted.

Figure 8:
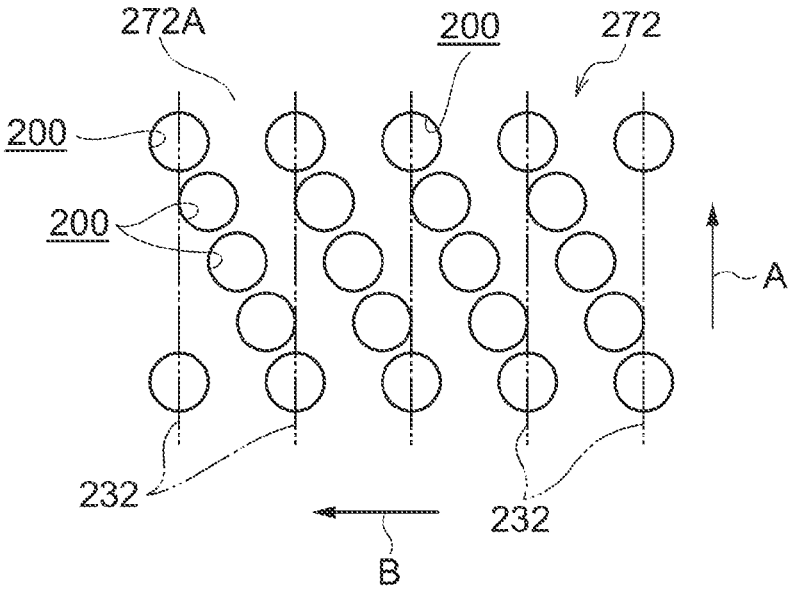
FIG. 8 is a plan view showing a portion of a suction plate that is used in an image forming device of a fourth embodiment.

A portion of a first guide plate 272, that serves as a suction plate and that is used in the inkjet recording device of the fourth embodiment, is shown in a plan view in FIG. 8. As shown in this drawing, the numerous suction holes 200 are formed in a top surface (sliding contact surface) 272A of the first guide plate 272. At the first guide plate 272, the interval between the suction holes 200 that are disposed along the conveying direction A of the sheet P is set to be narrow as compared with the first guide plate 242 that is shown in FIG. 5. At this first guide plate 272, the suction holes 200 are disposed so as to overlap in direction B, that is orthogonal to the conveying direction of the sheet P, when the numerous suction holes 200 are projected in the conveying direction A of the sheet P. Due thereto, the sheet P that is conveyed is made to be in a state in which there is no region thereof that is always contacting the top surface 272A of the first guide plate 272 (a position at which there are none of the suction holes 200).

The first guide plate 272 of the present embodiment is made to be a structure in which the suction holes 200, that structure the hole rows that run along the conveying direction A of the sheet P, are each offset by a uniform amount in the direction orthogonal to the conveying direction A of the sheet P, and return to the original arrangement of the hole row periodically (at the position of the fourth suction hole 200 in the conveying direction A of the sheet P). Namely, this is a structure that periodically returns to the original arrangement of the hole row, at the position of a central line 232 of the suction hole 200 that is the reference in the conveying direction A of the sheet P.

In such a structure, when the sheet P is conveyed in the arrow A direction while contacting (slidingly contacting) the top surface 272A of the first guide plate 272, dispersion arising in the cumulative passage times of the sheet P at the portions of the top surface 272A where the suction holes 200 are formed and the portions where the suction holes 200 are not formed is reduced (the contact times of the sheet P with the top surface 272A of the first guide plate 272 are made to be more uniform). Therefore, at the positions facing the ink drying processing units 68 (see FIG. 2) and the UV irradiating units 74 (see FIG. 2), the arising of differences in the temperature distribution of the sheet P is suppressed, and the occurrence of non-uniformity of the image can be suppressed.

An inkjet recording device that serves as an image forming device relating to a fifth embodiment of the present invention is described next by using FIG. 9. Note that structural portions that are the same as the above-described first through fourth embodiments are denoted by the same numbers, and description thereof is omitted.

Figure 9:
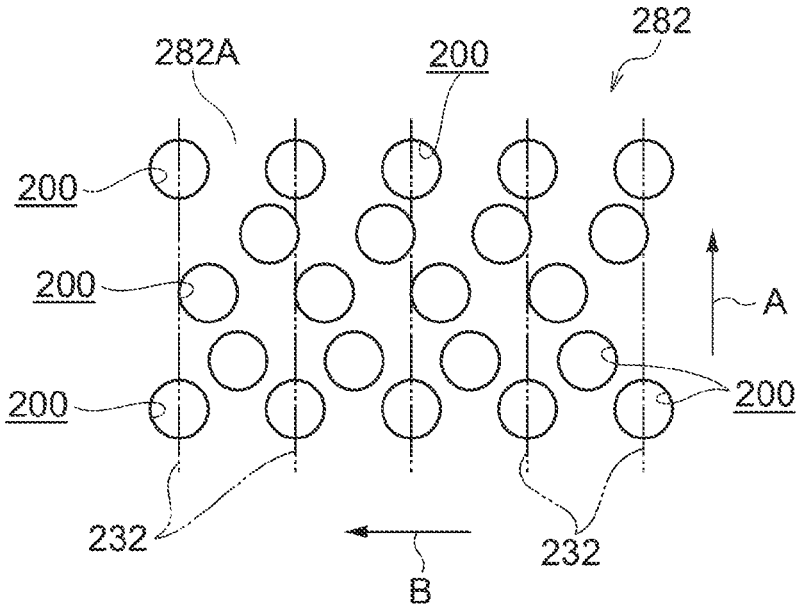
FIG. 9 is a plan view showing a portion of a suction plate that is used in an image forming device of a fifth embodiment.

A portion of a first guide plate 282, that serves as a suction plate and that is used in the inkjet recording device of the fifth embodiment, is shown in a plan view in FIG. 9. As shown in this drawing, the numerous suction holes 200 are formed in a top surface (sliding contact surface) 282A of the first guide plate 282, and the suction holes 200 are disposed so as to overlap in direction B that is orthogonal to the conveying direction of the sheet P, when the numerous suction holes 200 are projected in the conveying direction A of the sheet P. Due thereto, the sheet P that is conveyed is made to be in a state in which there is no region thereof that is always contacting the top surface 282A of the first guide plate 282 (a position at which there are none of the suction holes 200).

The first guide plate 282 of the present embodiment is made to be a structure in which the suction holes 200, that structure a hole row in the conveying direction A of the sheet P, are offset in direction B that is orthogonal to the conveying direction of the sheet P, and the arrays in direction B, that is orthogonal to the conveying direction of the sheet P, of the suction holes 200 whose hole positions are offset are disposed in a random order in the conveying direction A of the sheet P.

More concretely, while the row of holes, of a uniform pitch, of the suction holes 200 in the conveying direction A of the sheet P returns to the original arrangement of the row of holes periodically (between the suction holes 200 that are on positions of the central line 232 that is a reference in the conveying direction A of the sheet P), the array of the suction holes 200 whose positions are offset in direction B (the transverse direction of the sheet P) that is orthogonal to the conveying direction of the sheet P, is disposed in a random order in the conveying direction A of the sheet P. In the present embodiment, when the first guide plate 282 is compared with the first guide plate 272 shown in FIG. 8, with respect to the plural suction holes 200 that are the reference in the transverse direction of the sheet P at the conveying direction upstream side of the sheet P, the plural suction holes 200, that run along the transverse direction of the sheet P and that are next in the conveying direction A of the sheet P, are the arrangement of the second suction holes 200 of the first guide plate 272 shown in FIG. 8. The plural suction holes 200 that run along the transverse direction of the sheet P and that are next are the arrangement of the third suction holes 200 of the first guide plate 272 shown in FIG. 8. Moreover, the plural suction holes 200 that run along the transverse direction of the sheet P and that are next are the arrangement of the first suction holes 200 of the first guide plate 272 shown in FIG. 8.

Note that the array of the suction holes 200 (the array in the transverse direction of the sheet P) while the hole row of a uniform pitch of the suction holes 200 in the conveying direction A of the sheet P returns to the original arrangement of the hole row periodically (between the suction holes 200 on the central line 232 that is a reference in the conveying direction A of the sheet P), is not limited to the array of the present embodiment. Namely, the order, in the conveying direction A of the sheet P, of the array of the suction holes 200 can be changed. Further, there may be a structure in which, while the hole row of a uniform pitch of the suction holes 200 in the conveying direction A of the sheet P returns to the original arrangement of the hole row periodically (between the suction holes 200 on the central line 232 that is a reference in the conveying direction A of the sheet P), the plural suction holes 200 are disposed at random.

In such a structure, when the sheet P is conveyed in the arrow A direction while contacting (slidingly contacting) the top surface 282A of the first guide plate 282, dispersion arising in the cumulative passage times of the sheet P at the portions of the top surface 282A where the suction holes 200 are formed and the portions where the suction holes 200 are not formed is reduced (the contact times of the sheet P with the top surface 282A of the first guide plate 282 are made to be more uniform). Therefore, at the positions facing the ink drying processing units 68 (see FIG. 2) and the UV irradiating units 74 (see FIG. 2), the arising of differences in the temperature distribution of the sheet P is suppressed, and the occurrence of non-uniformity of the image can be suppressed.

<Other Points>

Although embodiments of the present invention have been described above, the present invention is not limited in any way to the above-described embodiments, and it goes without saying that the present invention can be implemented in various forms within a scope that does not depart from the gist thereof.

In the above-described first through fifth embodiments, the shape of the suction holes is circular, and the pitch between the suction holes is substantially equal to the hole diameter, and the sizes of the suction holes also are substantially uniform. However, the present invention is not limited to these. For example, the suction holes may be another shape such as angular holes, oblong holes, oval holes, or the like, and the sizes of the suction holes as well do not have to be uniform. Further, with regard to the pitch between the suction holes as well, even if set arbitrarily, this does not depart from the present invention. Further, when the suction holes are made to be angular holes such as rectangular, or oblong holes or oval holes, the direction of the long diameter portion of the suction holes is not particularly limited, and may be arranged in any direction.

Further, in the first and second embodiments, examples are given in which the way of offsetting the suction holes is such that the suction holes are each offset with respect to the conveying direction of the sheet P by ⅓ and ½ of the hole diameter. However, the present invention is not limited to this, and the amount of offset does not have to be regular.

Further, in the first through fifth embodiments, the first guide plate and the second guide plate that serve as suction plates are disposed at positions facing the ink drying processing units 68 and the UV irradiating processing units 74, but the present invention is not limited to this structure. For example, if there is a structure in which the suction plate of the present invention is disposed along the conveying mechanism that conveys the sheet after liquid drops of the sheet P have been applied, there is no need for the suction plate to face the drying device and the liquid drop curing device.

Moreover, the first through fifth embodiments are structures that eject inks onto the sheet P by inkjet heads, but the present invention is not limited to this structure. For example, there may be a structure that applies liquid drops to the sheet P by using a method other than inkjet heads.

The disclosure of Japanese Patent Application No. 2013-044448 is, in its entirety, incorporated by reference into the present specification.

All publications, patent applications, and technical standards mentioned in this specification are incorporated by reference into the present specification to the same extent as if such individual publication, patent application, or technical standard was specifically and individually indicated to be incorporated by reference.

What is claimed is:

1. An image forming device comprising:

a conveying mechanism that pulls and conveys a recording medium onto which liquid drops have been applied; and a suction plate that is provided with a plurality of suction holes that suction the recording medium conveyed by the conveying mechanism, and at which sizes of the plurality of suction holes are uniform, and, when the suction holes are projected in a conveying direction of the recording medium, suction holes in a same row are disposed such that any one of the suction holes in the same row is disposed in a direction that is orthogonal to the conveying direction of the recording medium with respect to another hole in the same row, and the suction holes in the same row are disposed in the conveying direction so as to overlap one another, wherein the conveying mechanism has a chain gripper that grasps a leading end portion of the recording medium and conveys the recording medium, which slidingly contacts the top surface of the suction plate, along the suction plate.

2. The image forming device of claim 1, wherein the suction holes, which are in the same row of holes in the conveying direction of the recording medium, are configured so as to be offset, each by a uniform amount, in the direction that is orthogonal to the conveying direction of the recording medium, and periodically return to an original arrangement of the row of holes.

3. The image forming device of claim 1, wherein the suction holes, which are in the same row of holes in the conveying direction of the recording medium, are offset in the direction that is orthogonal to the conveying direction of the recording medium, and arrays of the suction holes, having hole positions offset and that are in the direction that is orthogonal to the conveying direction of the recording medium, are disposed in a random order in the conveying direction of the recording medium.

4. The image forming device of claim 1, wherein a drying device, which dries the liquid drops that have been applied to the recording medium, is provided at a position facing the suction plate.

5. The image forming device of claim 4, wherein a cooling liquid circulating device, which cools a surface of contact with the recording medium by circulating cooling liquid at an interior of the suction plate, is provided at the suction plate.

6. The image forming device of claim 4, wherein a liquid drop curing device, which cures the liquid drops that have been applied to the recording medium, is provided further toward a conveying direction downstream side of the recording medium than the drying device.

* * * * *